US011745047B2

(12) United States Patent
Vaudreuil

(10) Patent No.: US 11,745,047 B2
(45) Date of Patent: Sep. 5, 2023

(54) EXERCISE WEIGHT SAFETY HARNESS AND CLAMP

(71) Applicant: Michael P. Vaudreuil, Vernon, CT (US)

(72) Inventor: Michael P. Vaudreuil, Vernon, CT (US)

( * ) Notice: Subject to any disclaimer, the term of this patent is extended or adjusted under 35 U.S.C. 154(b) by 0 days.

(21) Appl. No.: 17/460,621

(22) Filed: Aug. 30, 2021

(65) Prior Publication Data

US 2022/0062688 A1 Mar. 3, 2022

Related U.S. Application Data

(60) Provisional application No. 63/072,216, filed on Aug. 30, 2020.

(51) Int. Cl.

| | |
|---|---|
| ***A63B 21/078*** | (2006.01) |
| ***A63B 71/00*** | (2006.01) |
| ***A63B 21/072*** | (2006.01) |

(52) U.S. Cl.

CPC ..... *A63B 21/0783* (2015.10); *A63B 21/0726* (2013.01); *A63B 71/0054* (2013.01); *A63B 2071/0072* (2013.01)

(58) Field of Classification Search

CPC ..... A63B 21/0783; A63B 21/0726; A63B 71/0054; A63B 2071/0072; A63B 21/4035

See application file for complete search history.

(56) References Cited

U.S. PATENT DOCUMENTS

| | | | | |
|---|---|---|---|---|
| 2009/0192025 | A1* | 7/2009 | Minerva | A63B 21/4017 482/93 |
| 2014/0073493 | A1* | 3/2014 | Parish | A63B 21/0724 482/104 |
| 2016/0263461 | A1* | 9/2016 | Kay | A63B 21/153 |

* cited by examiner

*Primary Examiner* — Sundhara M Ganesan

*Assistant Examiner* — Jacqueline N L Loberiza

(74) *Attorney, Agent, or Firm* — Armis IP Law, LLC

(57) ABSTRACT

A safety tether or harness attaches to a handle of a dumbbell for providing freedom of movement within a normal exercising range of motions but support the dumbbells via the tether outside the usage range. A clamp engages the handle of the dumbbell, and the tether is defined by a loop of cable, chain or robe that encircles an overhead bar or frame. The loop allows lateral movement along the overhead bar. The clamp engages the dumbbell at the bar in a spring loaded interference fit to prevent accidental release. The tether length supports the dumbbell at or just below a rest position defined by outstretched arms, such that an ungrasped or dropped dumbbell is suspended at the rest position to avoid injury or damage from a free fall down to the floor level.

22 Claims, 8 Drawing Sheets

EXERCISE WEIGHT SAFETY HARNESS AND CLAMP

RELATED APPLICATIONS

This patent application claims the benefit under 35 U.S.C. § 119(e) of U.S. Provisional Patent App. No. 63/072,216, filed Aug. 30, 2020, entitled "DUMBBELL WEIGHT HARNESS AND CLAMP," incorporated herein by reference in entirety.

BACKGROUND

Free weights such as dumbbells and barbells provide a simple and inexpensive device for resistance based exercise. A bar with weights at either end provides a reliable piece of equipment and an absence of moving parts that can impose maintenance and safety concerns. Resistance is provided by gravitational force on the weights, and in some designs is variable by adding additional weights, or plates. Others provide a unitary molded design and often take the form of multiple dumbbells in a series of increasing mass.

SUMMARY

A safety tether or harness for free weights attaches to a handle of each of a pair of dumbbells for providing freedom of movement within a normal range of motions but support the dumbbells via the tether outside the usage range, such as at a predetermined height. The tethers attach to a stable overhead bar or point and the length of the tether defines a maximum lower travel range based on a rest position for the exercise being performed. The restraint device takes the form of a clamp engaging the bar or handle of the dumbbell, and the tether is defined by a loop of cable, chain or robe that encircles an overhead bar or frame. The loop allows lateral movement along the overhead bar. The clamp engages the dumbbell at the handle in a spring loaded interference fit to prevent accidental release. A typical scenario disposes the user laying on their back with outstretched arms to manipulate the weights during an exercise routine, typically an up and down vertical movement. The tether length supports the dumbbell at or just below a rest position defined by outstretched arms, such that an ungrasped or dropped dumbbell is suspended at the rest position to avoid injury or damage from a free fall down to the floor level.

Configurations herein are based, in part, on the observation that dumbbells concentrate a substantial mass for use with resistance based exercise. Unfortunately, conventional approaches to free weight management suffer from the shortcoming that the dumbbells remain unrestrained and may cause injury if an unprepared or exhausted user is unable to provide proportional resistance while in a relatively vulnerable position on an exercise bench. Accordingly, configurations herein substantially overcome the shortcomings of conventional free weights by tethering the weights from a clamp around the handle for suspending the dumbbell at a predetermined height if the dumbbell is released. In particular, commencement and termination of an exercise routine disposes a user in a particularly vulnerable position supporting the dumbbells (typically one in each hand) while engaging or disengaging from a back-lying exercise position. Conventional approaches often employ a spotter or helper to position the weights into a position suited for vertical movement with a back-laying user. The approach herein obviates the need for a spotter for back-laying as well as exercises performed in a sitting or standing position.

A safety restraint device as disclosed herein for preventing unexpected or uncontrolled movement of exercise equipment includes a clip adapted to engage a resistance object during use, in which the resistance object prone to inertial movement from external forces, such as gravity or machine imposed resistance. A linkage is adapted to attach the clip to a tether, such that the tether exerts a counterforce against the inertial movement of the resistance object to prevent injury in a breakaway or sudden release situation. A restraint secures the clip in communication with the resistance object, and a selective biasing member biases the restraint in engagement with the resistance object during exertion of the counterforces to secure the clip during normal exercise.

In particular, this approach is useful as a safety restraint device for a free weight, in which opposed clips are adapted for attachment to a handle of a free weight. Any suitable resistance object, such as a dumbbell, barbell, or other object of resistance based training. A free weight typically has a handle flanked by plates defining a fixed weight determined in accordance with the exercise parameters. The clips have a spacing for engaging the handle at locations flanking a grip region of the handle adjacent a hand of a user. A receptacle on the clips receives the handle of the free weight. The tether attaches to the opposed clips at one end, and also suspends the tether from a secure structure such as an overhead bar. The restraint secures the clip to the handle, in which the restraint has a spring-loaded actuator for biasing the restraint in a secured position.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

The description below presents an example of the safety restraint device in conjunction with dumbbells for preventing a mishandling or free fall of a dropped or mishandled dumbbell. The restraint device is applicable to a variety of configurations of resistance objects including as weights and potential or stored energy exercise members, such as elastic strands and spring or coil loaded approaches that invite physical exertion against a stored force.

A safety restraint device for a free weight as disclosed herein includes opposed clips adapted for attachment to a handle of a free weight. The clips have a spacing for engaging the handle at locations flanking a grip region of the handle. A receptacle or slot on the clips is shaped for receiving the handle as the clips engage on each side of the user's hand. This allows direct grip of dumbbell handle, in contrast to conventional approaches that require intervening "deadman" type of interfering protrusion that need be simultaneously gripped. Such conventional schemes impose a parallel member on the handle that effectively increases the apparent diameter or cross section of the handle, adversely affecting a manual grip.

Figure 1:
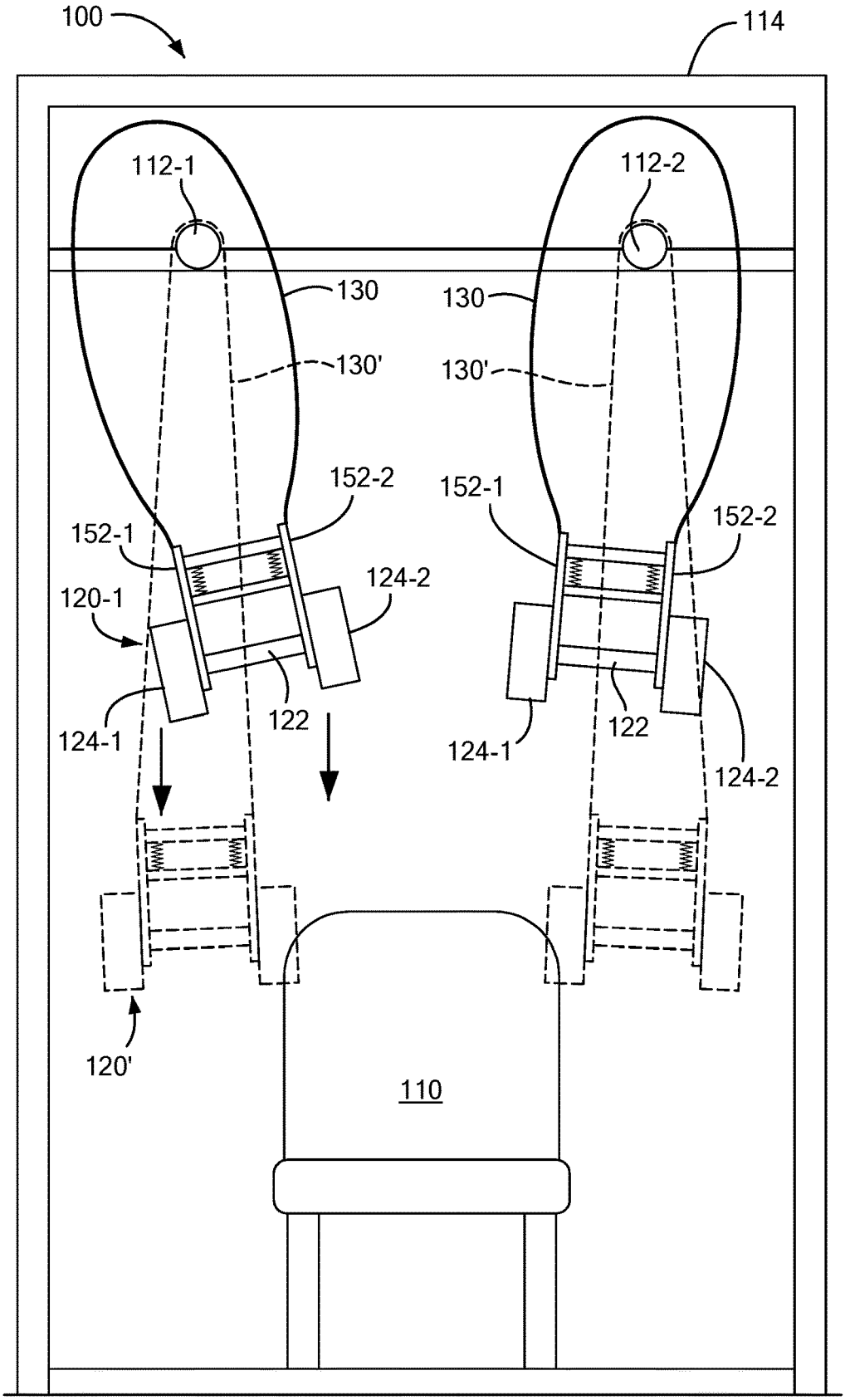
FIG. 1 is a front view on an exercise environment and apparatus suitable for use with configurations herein.

FIG. 1 is a front view on an exercise environment and apparatus suitable for use with configurations herein. Referring to FIG. 1, in an exercise environment 100 such as a fitness establishment or home gym, an exercise bench 110 is often used by an athlete in a prone or lying position. Conventional approaches typically have free weights such as dumbbells and barbells strewn around, or perhaps on a nearby shelf. For larger barbells, an overhead rack may flank the bench for idle support of a barbell when not in use. Conventional approaches fail to allow substantial freedom of movement around the bench 110 and exercise environment 100 while still effectively restraining the free weight in the event of droppage or other loss of control. Dropped or projected free weights can cause substantial injury, particularly when lightweight athletic footwear is worn.

In contrast to conventional approaches, in of FIG. 1, a resistance object such as a dumbbell 120-1 . . . 120-2 (120 generally) is suspended from a retention bar 112-1 . . . 112-2 (112 generally) attached to an overhead frame 114. Each dumbbell 120 has a central handle 122 flanked by opposed plates 124-1 . . . 124-2. Each of the plates 124 generally has a predetermined mass that, along with a weight of the handle, provides training resistance simply through gravitational force. Each dumbbell 120 has a clamp, including clips 152-1 . . . 152-2 adjacent to the plates 124 and attached to tethers 130 that form a loop around the retention bar 112. In the event of droppage or loss of control of the dumbbell 120, the dumbbell would partially fall to the position 120', at which point the tethers 130' become taught and the exert a counterforce against the gravitationally driven inertial movement of the dumbbell to prevent injury. It will be apparent that the clips 152, tethers 130, overhead frame 114 and retention bar 112 have ample integrity to accommodate the fall and impact from the mass of the dumbbells being used.

Figure 2A:
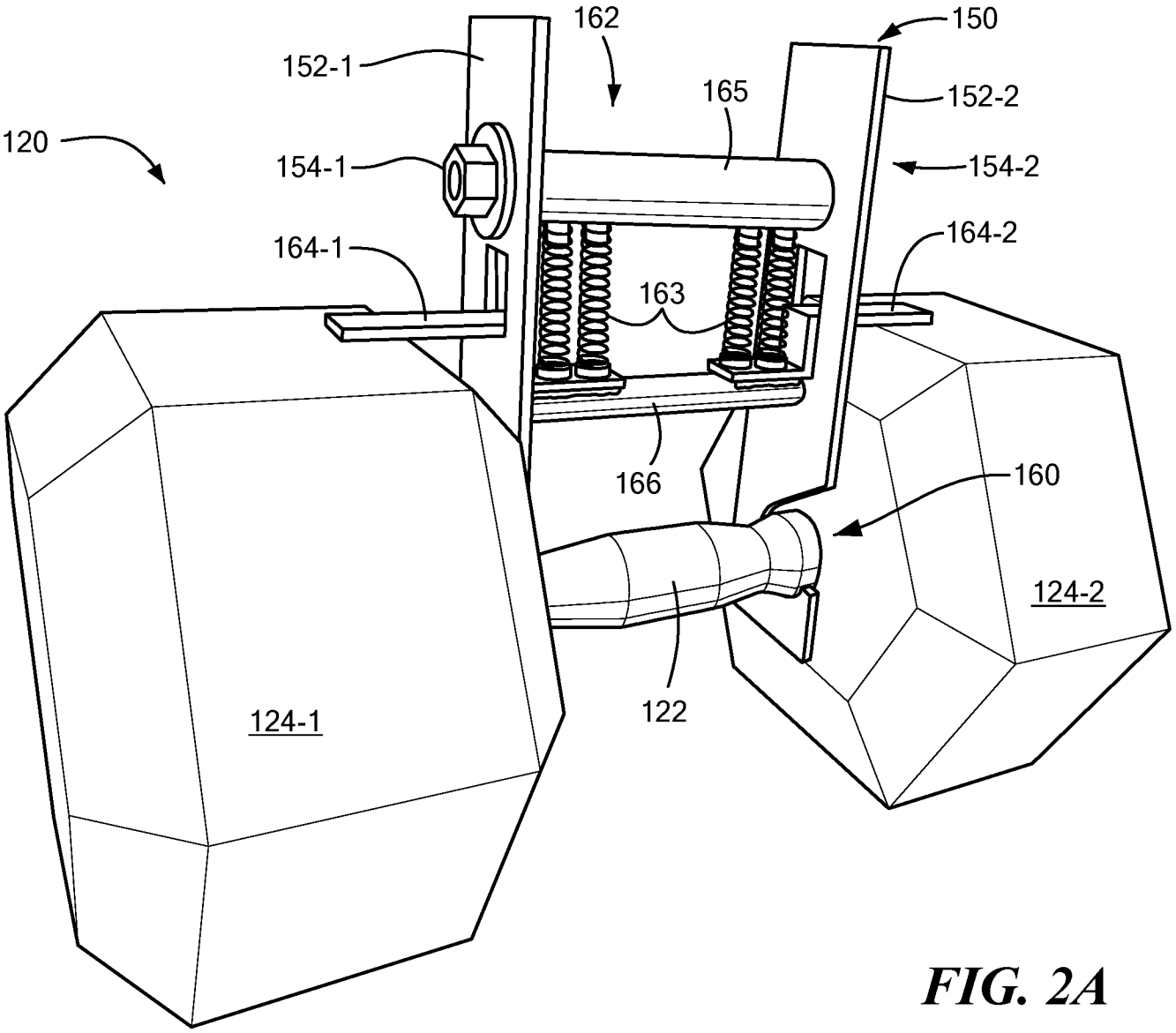
FIGS. 2A and 2B are perspective and front views, respectively, of an outrigger configuration of the clip.
Figure 2B:
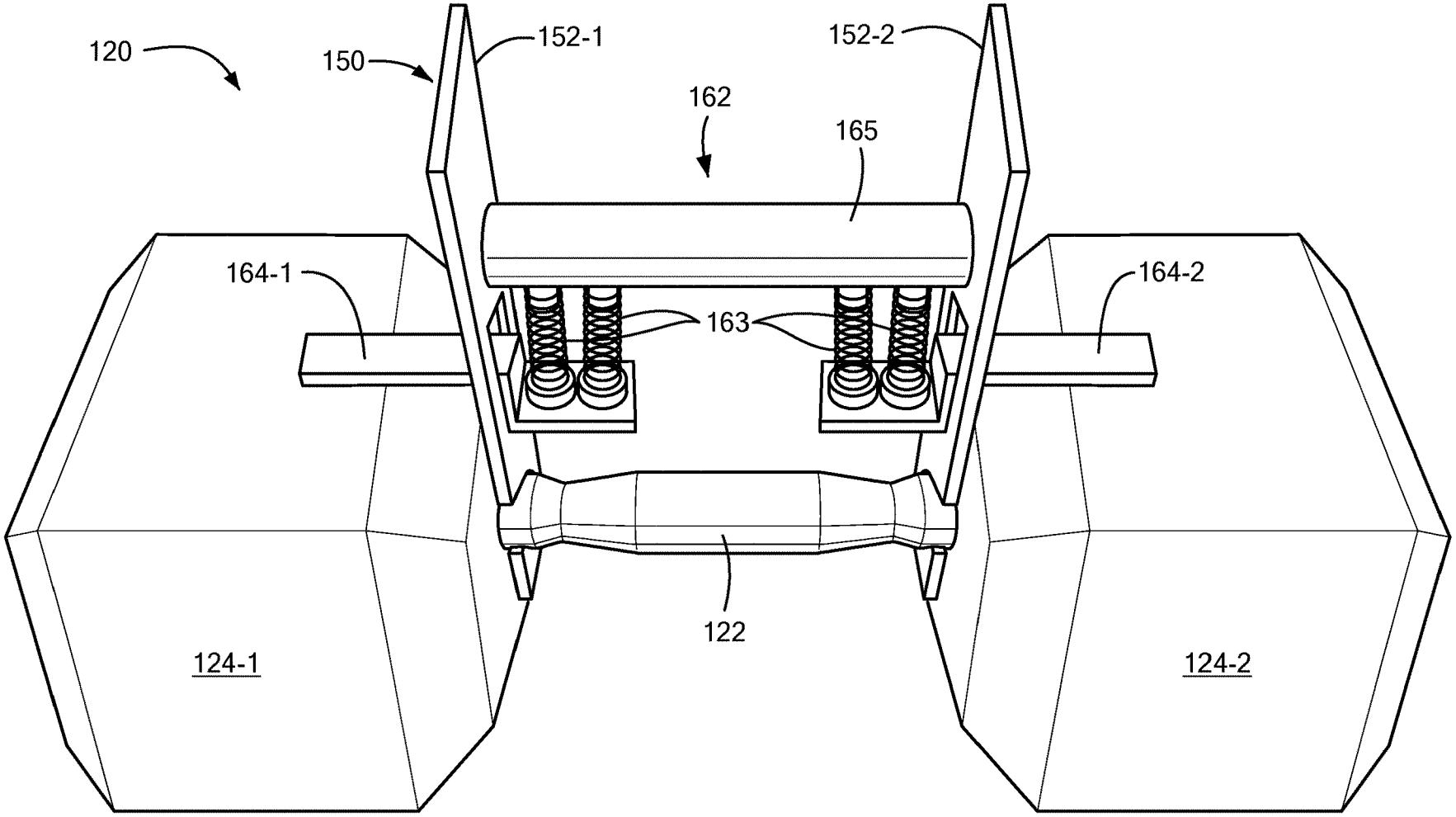

FIGS. 2A and 2B are perspective and front views, respectively, of an outrigger configuration of the clamp 150. Referring to FIGS. 1, 2A and 2B, the clamp 150 includes a pair of clips 152 adapted to engage a resistance object such as a dumbbell 120 during use. The resistance object could be any mass used in weight training that could be prone to inertial movement from external force, such as barbells and other free weights. The clamp 150 includes a linkage 154-1 . . . 154-2 adapted to attach the clip to a respective tether 130. Each tether 130 can restrain a dropped dumbbell 120 by drawing taut to exert a counterforce against the inertial movement of the resistance object to prevent injury, typically from gravitational forces.

The clamp 150 secures the dumbbell by engaging the handle 122 where an athlete typically grasps the dumbbell 120 for use. The handle is typically a rod or bar passing through the center of each plate 124, or molded to the plates as a unitary assembly. Each clip includes a slot 160 having a size for receiving the handle 122 and defining an engagement portion. The slot 160 has a width slightly larger than the handle, and generally angles downward relative to an upright position where the tethers 130 extend upwards from the clamp.

While the angle of the slot 160 extending downward, the handle 122 will tend to be engaged and "bottom out" in the slot 160 if dropped. However, as the athlete may manipulate the dumbbell in a variety of positions, the clamp 150 employs a restraint for securing the clip in communication with the dumbbell. In general, the restraint maintains an interference fit with the handle 122 or the plates 124 for maintaining the handle 122 engaged in the slot 160. A biasing member 163 is operable for selective disengagement such that the handle 122 remains disposed in the engagement portion when the biasing member 163 is engaged with the resistance object. The restraint may take one of several forms; configurations including an elongated outrigger 164 (outrigger) or a retention member are now discussed below.

Both the outrigger 164 and retention member (discussed below in FIGS. 4A-5B) configurations employ a handle frame 162 defined by a crossmember 165 attached between a plurality of opposed clips 152, typically a pair. A receptacle defined by the slot 160 in each of the opposed clips 152 receives the handle 122 of the resistance object in a manner such that the handle 122 extends parallel to the crossmember 165 and perpendicular to the clips 152. A hand grip defines the actuator 166 disposed between the opposed clips 152 and adapted to simultaneously retract the restraint by movement against the biasing member 163 for releasing the handle 122 from the clips 152. The full clamp 150 includes the clips 152 and handle frame 162 for securing the clips to the resistance object.

Figure 3B:
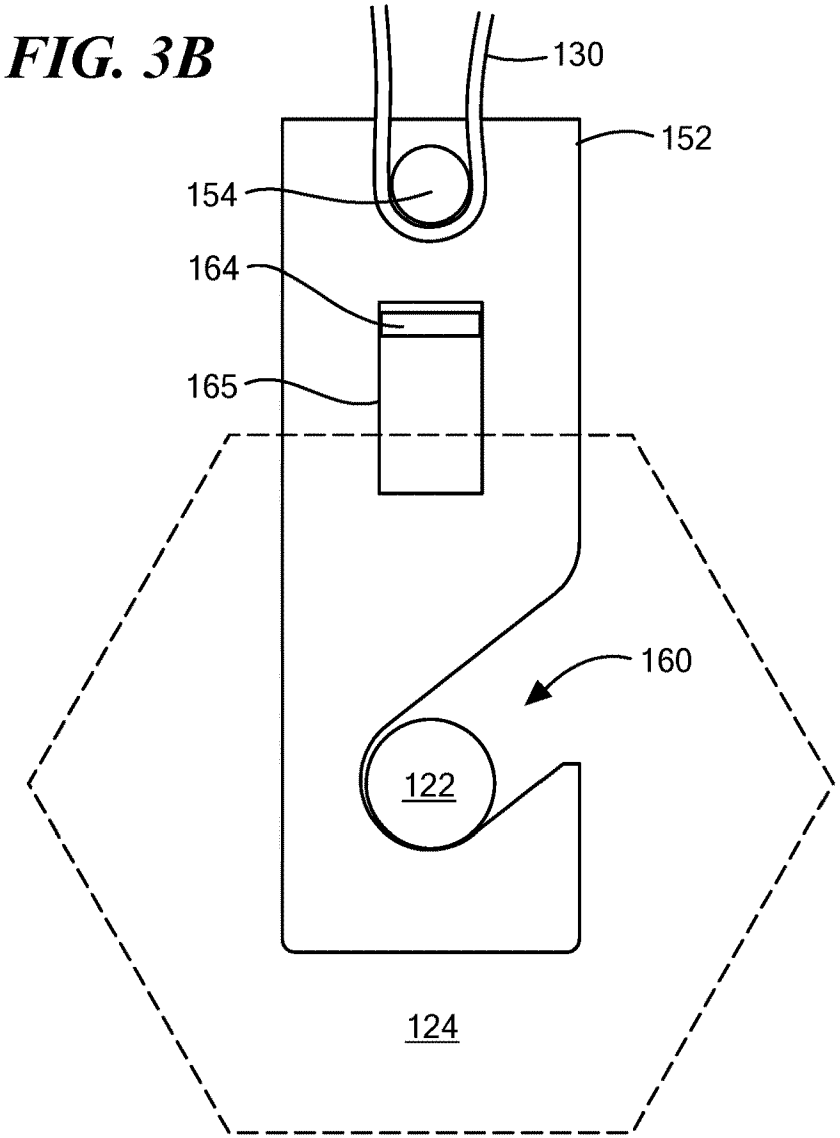
FIGS. 3A and 3B are side schematic views of the clip of FIGS. 2A and 2B in engaged and disengaged positions.
Figure 3A:
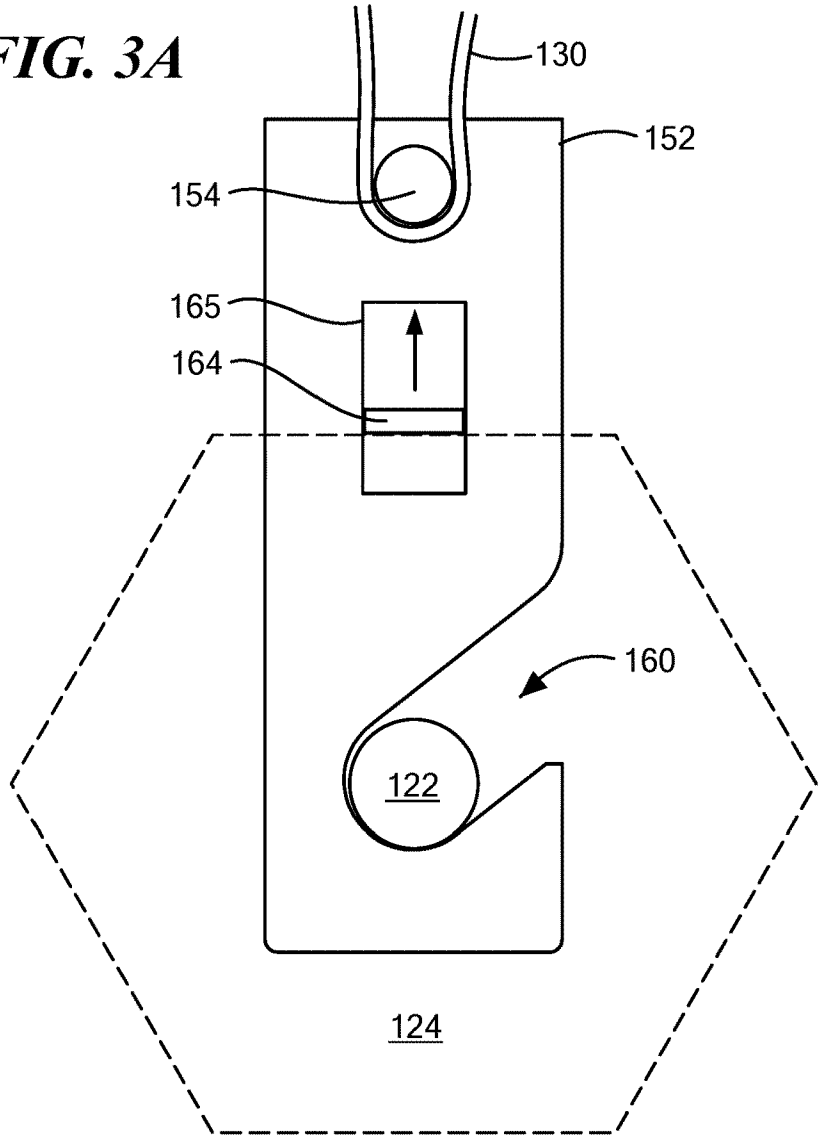

FIGS. 3A and 3B are side schematic views of the clip of FIGS. 2A and 2B in engaged and disengaged positions. Referring to FIGS. 3A and 3B, and continuing to refer to FIGS. 1-2B, the biasing member 163 is for biasing the restraint in engagement with the resistance object during exertion of the counterforces. This could be a spring loaded, elastic or resilient member, or other fixation that can be selectively disengaged or detached when the user wishes to remove the dumbbell from the clamp.

In the configuration of FIGS. 2A-3B, the restraint includes an elongated outrigger 164-1 . . . 164-2 (164 generally), such that each elongated outrigger 164 extends outward from the clip 152 and away from the clip of the opposed plate 124. The elongated outrigger 164 engages the plate 124 in an interference arrangement with movement of the handle from the slot 160. The outriggers 164 are biased by the biasing member 163, such as a spring, against the respective plate 124 for securing the handle 122 in the slot 160. The outrigger and restraint assembly also includes a release defined by an actuator 166 for releasing the restraint from engagement with the resistance object. Thus, the release is configured for disposing the actuator against a biasing force of the biasing member 163 by compressing the spring 163 in response to an athlete's grip. In the example shown, the actuator 166 is a hand grip configured to compress the biasing member 163 for releasing the biasing force for disengaging the clip from engagement with the resistance object.

The restraint provides a selective release and is responsive to disengage from the receptacle when unbiased by an external force. In the example shown, a spring 163 loaded mechanism forces the restraint against the dumbbell to secure it in the receptacle until the user releases by compressing the spring loaded mechanism. In an example arrangement, the restraint includes a pair of outriggers 164 extending parallel to the handle and beyond the plates, such that each outrigger 164 is responsive to the actuator 166 for biasing against a respective plate attached to opposed ends of the handle. Each outrigger 164 is slidably engaged with a respective clip 152 and extends through a cutout 165, in which the outriggers 164 secure the receptacle in engagement with the handle when biased against the plates 124, and release the handle from the receptacle when the spring loaded actuator is unbiased for disposing the outriggers 164 away from the plates. Spacers or blocks may be incorporated on the outriggers 164 to accommodate varying diameters of plates.

The outriggers 164 are responsive to a hand grip control for disposing the outriggers 164 away from the plates responsive to disposing the hand grip against the spring bias. Typically this is a manual "squeezing" of the actuator 166 of the spring loaded mechanism to draw the outriggers 164 away from the plates 124 against which they are biased. The tether 130 attaches to both clips 152 to balance the counterforce applied to each clip in a free fall event, and the spring bias mechanism releases in response to an upward movement, so that the downward momentum of the dumbbell does not operate to release the outriggers 164 from the plates. Alternatively, a single clip 152 could suspend the dumbbell, however would deny the described symmetry.

Figure 4B:
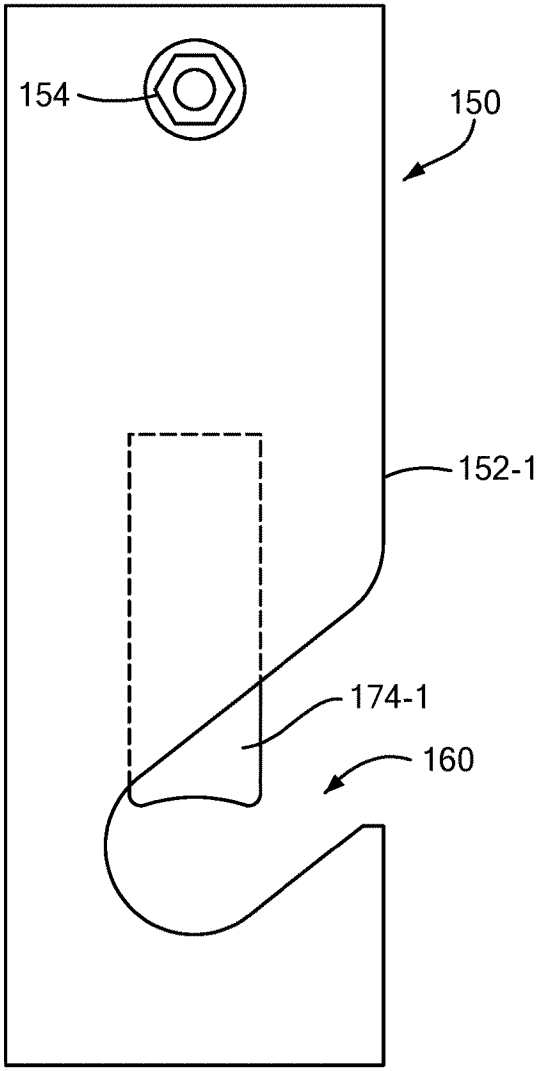
FIGS. 4A and 4B are perspective and side views, respectively, of a retention member restraint configuration.
Figure 4A:
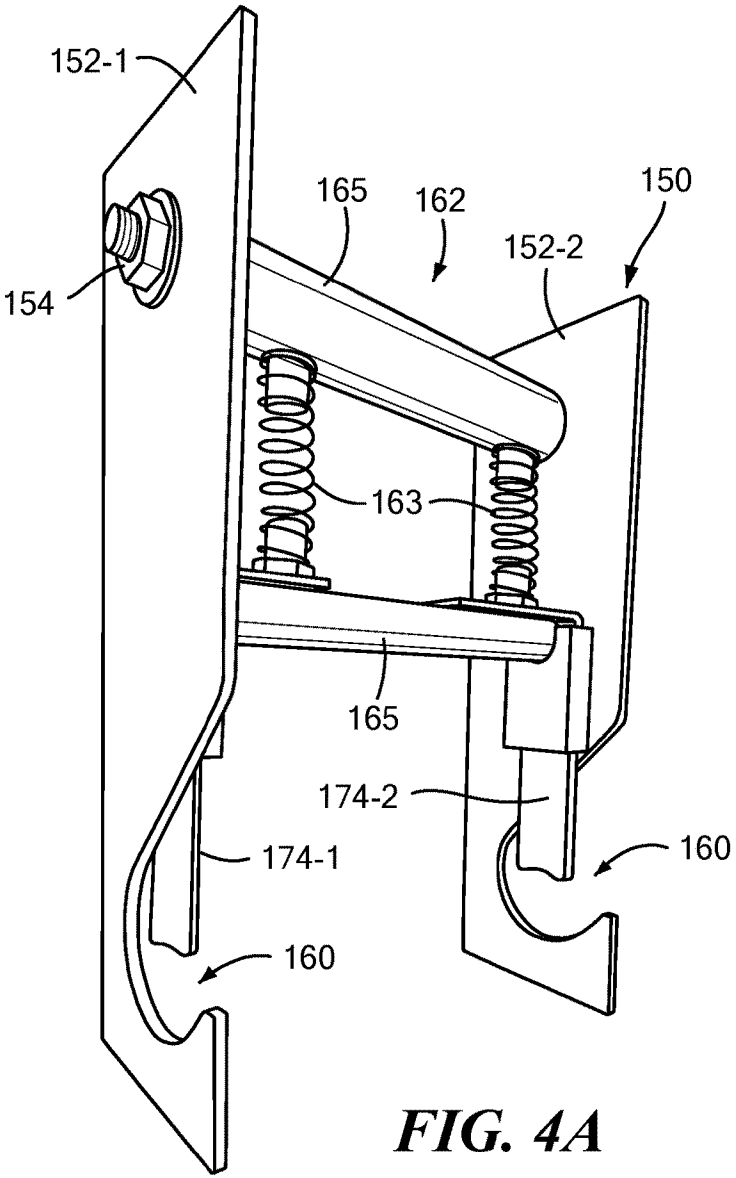

FIGS. 4A and 4B are perspective and side views, respectively, of a retention member restraint configuration. Referring to FIGS. 4A and 4B, the restraint includes retention members 174-1 . . . 174-2 (174 generally) adapted for movement in a plane parallel to the clip 152 and towards the receptacle for biasing the restraint in an interference fit with the handle 122 in the engagement portion. The retention members 174, rather than outriggers 164, are spring biased to engage the handle 122, rather than the plate 124. The opposed clips 152 define the grip region based on a location for engaging each receptacle with the handle, and the separation is based on a width of an athlete's hand. In other words, the retention members 174, typically thin planar metal extensions, slide down against the handle 122 adjacent the plates as the athlete's hand grips the handle between the retention members 174.

Figure 5B:
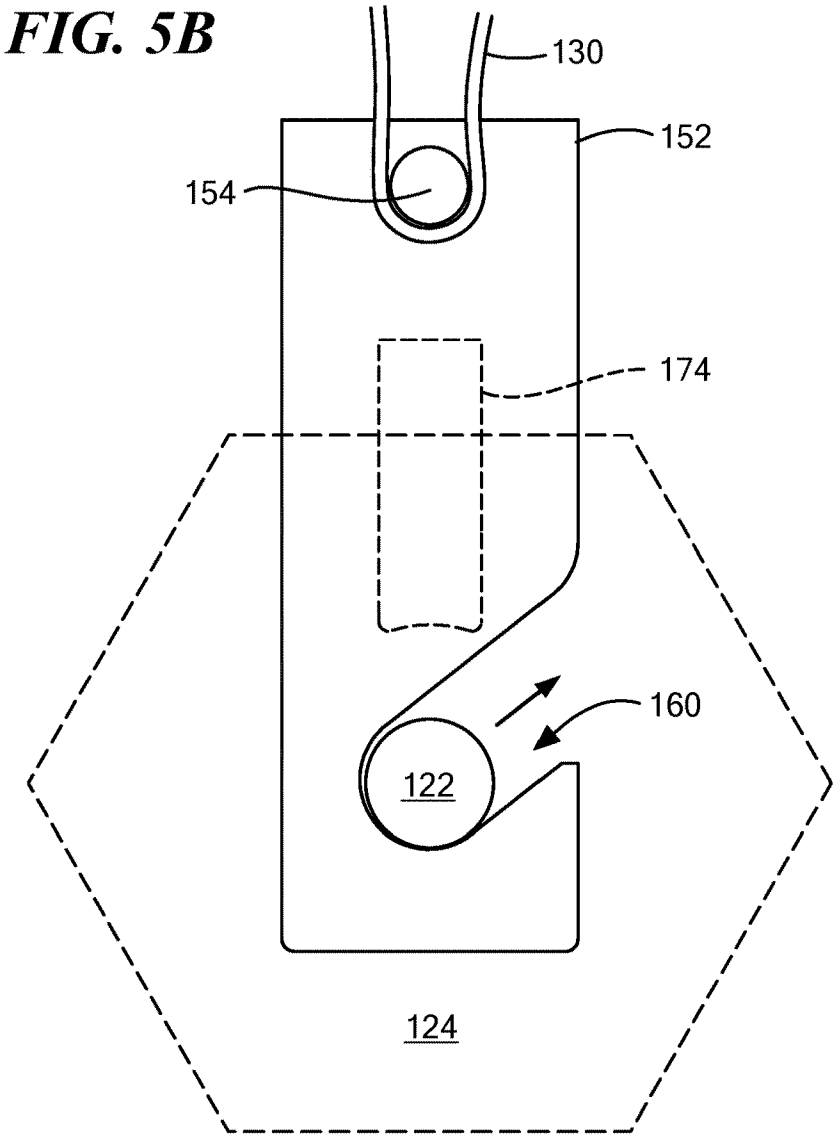
FIGS. 5A and 5B are side schematic views of the clip of FIGS. 4A and 4B in engaged and disengaged positions.
Figure 5A:
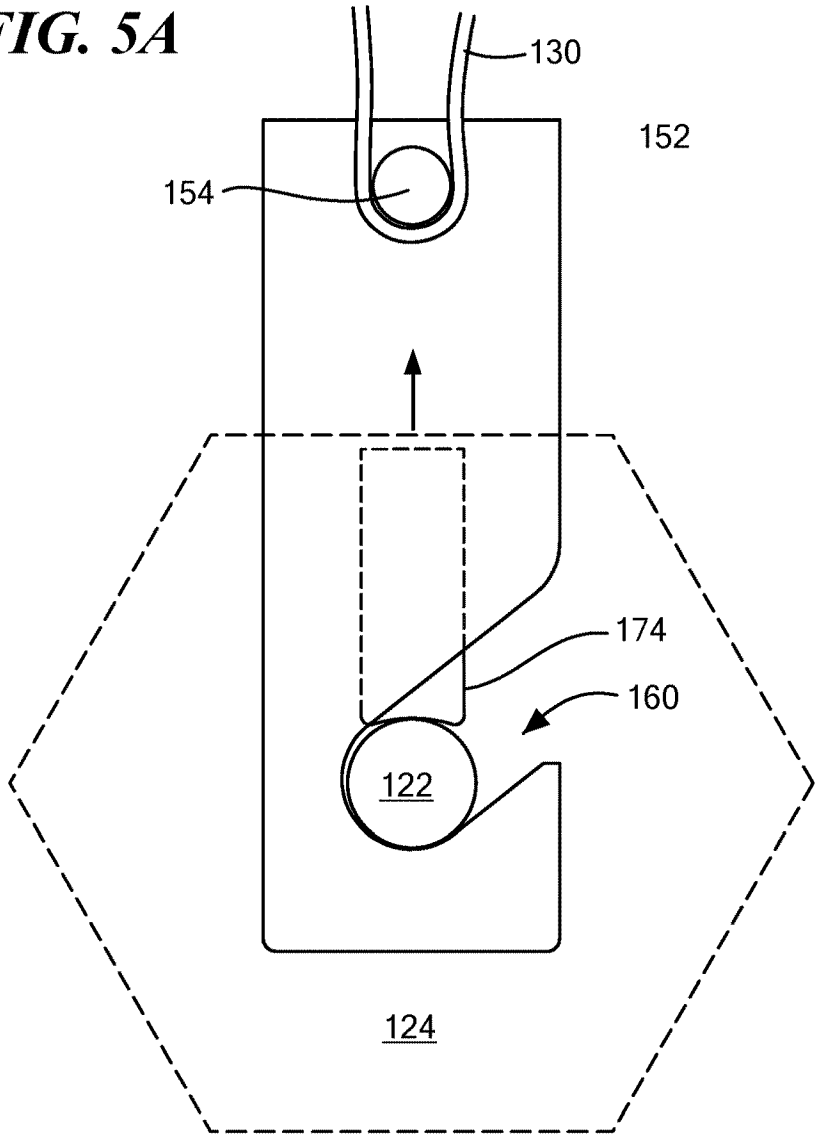

FIGS. 5A and 5B are side schematic views of the clip of FIGS. 4A and 4B in engaged and disengaged positions. During use, the biasing member 163 biases the retention members 174 against the handle 122 in an interference fit. The hand grip is responsive to retract the restraints by compressing the springs and drawing the retention members towards the crossmember 165 and away from the slot 160, releasing the handle 122 from the slot as shown by arrows.

Figure 6:
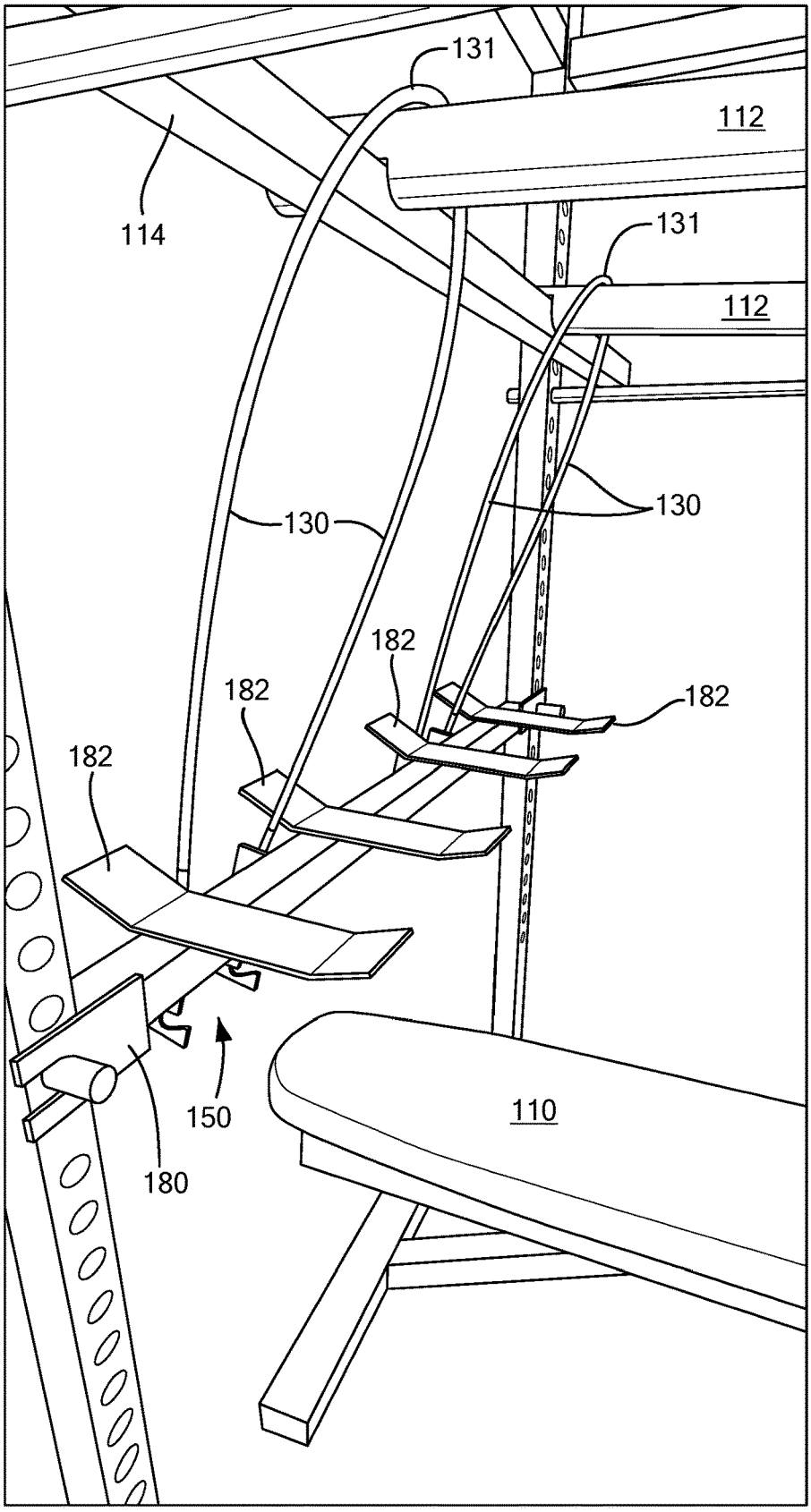
FIG. 6 is a perspective view of an overhead frame and attached tether of the configurations of FIGS. 1-5B.

FIG. 6 is a perspective view of the overhead frame 114 and attached tethers 130 of the configurations of FIGS. 1-5B. The tethers 130 attach to the opposed clips 152, and form a loop 131 configured for suspension around the retention bar 112 or other overhead member. The retention bar 112 is adapted for supporting the dumbbell, and allows free lateral movement along its length as the loop 131 may freely slide or traverse along the retention bar.

A lateral support 180 enhances stability and also operates to store the dumbbells from attached rack plates 182. Each of a plurality of rack plates 182 may be sized and spaced for supporting a dumbbell within the range of the tether, so that the dumbbells need not be stored hanging from the tethers 130.

Figure 7:
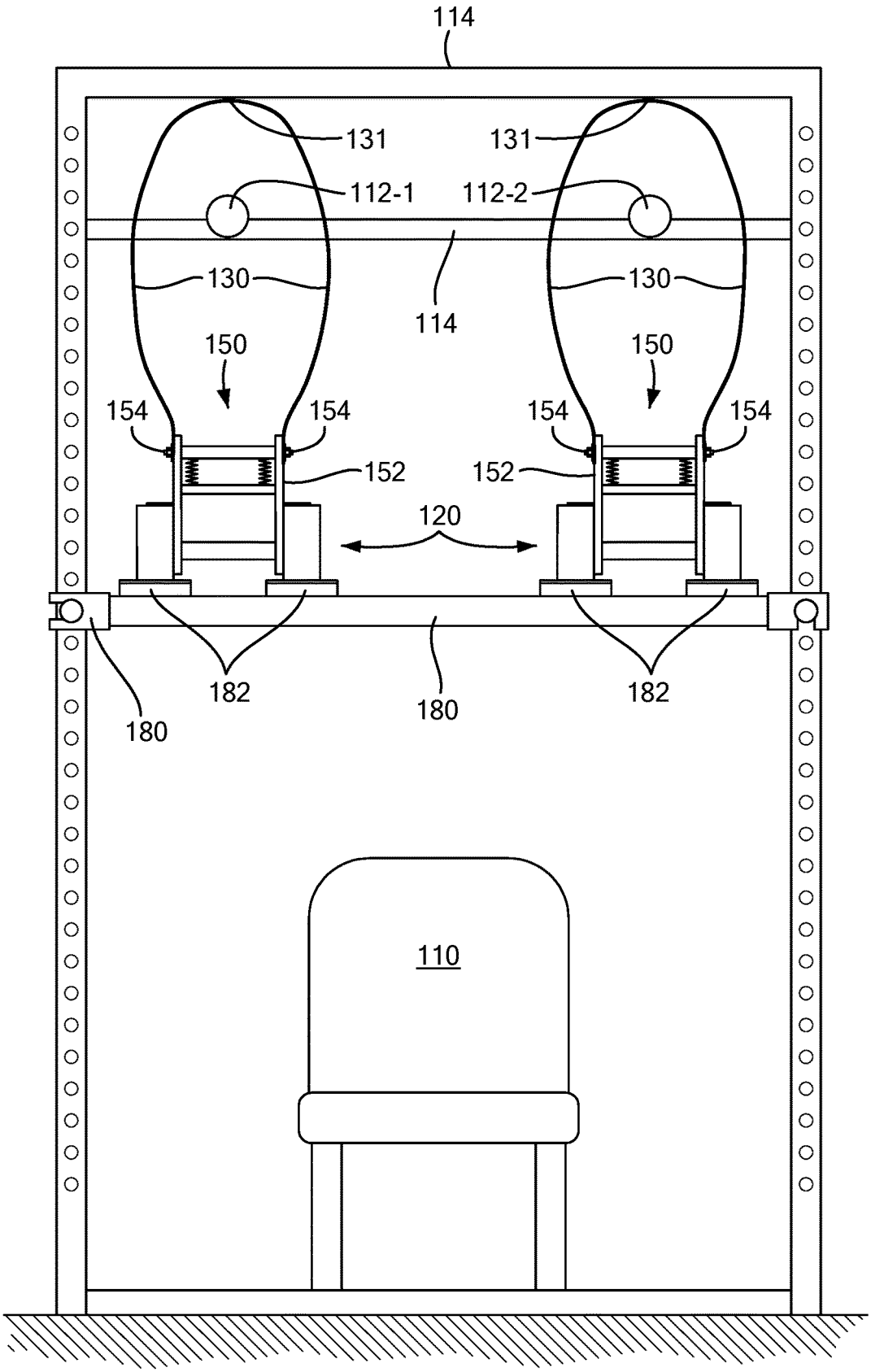
FIG. 7 is front elevation of the frame of FIG. 6 with the clips engaging a resistance object.

FIG. 7 is front elevation of the frame of FIG. 6 with the clips engaging a resistance object. Referring to FIGS. 6 and 7, the tethers 130 are shown in the loop 131 configuration around dual retention bars 112-1 . . . 112-2 (112 generally) resting on the rack plates 182. Unitary or singular cables may also be employed, but the loop tether balances the restraint by securement on either side of the hand/grip. It is beneficial that the loop retain a natural degree of rigidity to maintain shape to avoid interfering in exercise based movement. The restraint secures the clip 152 to the handle 122 or plate 124 via the spring loaded actuator for biasing the restraint in a secured position. In this manner, a dropped or released dumbbell is supported by the tether 130 rather than free-falling to the floor or against the user in an injurious manner.

It can be observed that each clamp 150 attaches to plurality of linkages (typically 2), such that each linkage 154 has a respective tether 130, where at least two of the tethers define the loop 131 between respective linkages 154.

In FIG. 7, the resistance object is demonstrated as a free weight or dumbbell including a handle 122 disposed between opposed plates 124 attached to respective ends of the handle. Each of the plates 124 has a predetermined mass for defining the resistance object, where the clamp 150 comprising a clip adjacent each of the opposed plates and adapted to engage the handle at respective opposed ends. Other suitable resistance objects may be restrained by attaching the clip 152 and tether 130 in an manner to oppose the force exerted by the resistance object. For example, a rigid upright that deforms in a horizontal direction would mount the tether to a fixture on a vertical surface opposite the resistive exercise force. While free weights simply use gravitational force to provide the needed resistance, some exercise apparatus include resilient and/or deformable members extending in other directions, and bend or deform in response to user force. The tethers are intended to resist sudden, uncontrolled force in the direction of resistance imposed by the equipment, whether gravitational or other While the system and methods defined herein have been particularly shown and described with references to embodiments thereof, it will be understood by those skilled in the art that various changes in form and details may be made therein without departing from the scope of the invention encompassed by the appended claims.

What is claimed is:

1. A restraint device for preventing unexpected or uncontrolled movement of exercise equipment, comprising:

a clip adapted to engage a resistance object, the resistance object prone to inertial movement from external force and having a handle between opposed plates of a free weight;

a linkage adapted to attach the clip to a tether, the tether exerting a counterforce against the inertial movement of the resistance object to prevent injury;

a restraint for securing the clip in communication with the resistance object by receiving the handle in a slot of the clip; and a biasing member for biasing the restraint in engagement with the resistance object disposed in the slot during exertion of the counterforce.

2. The device of claim 1 further comprising a release, the release including an actuator for releasing the restraint from engagement with the resistance object.

3. The device of claim 2 wherein the actuator is disposed against a biasing force of the biasing member.

4. The device of claim 1 further comprising a plurality of clips and a plurality of linkages, wherein a respective linkage is attached to each clip of the plurality of clips, each linkage having a respective tether, at least two of the tethers defining a loop between the respective linkages.

5. The device of claim 1 wherein the handle is disposed between the opposed plates attached to respective ends of the handle, the plates having a predetermined mass for defining the resistance object, further comprising a plurality of clips, each respective clip adjacent each of the opposed plates and adapted to engage the handle at the respective opposed ends.

6. The device of claim 5 wherein each clip includes a respective slot, the slot having a size for receiving the handle and defining an engagement portion, the handle disposed in the engagement portion when the biasing member is disposed in engagement with the resistance object.

7. The device of claim 6 wherein the restraint includes an elongated outrigger, the elongated outrigger extending outward from the clip and away from the clip of the opposed plate, the elongated outrigger engaging the plate in an interference arrangement with movement of the handle from the slot.

8. The device of claim 3 wherein the actuator is a handle, the handle configured to compress the biasing member for releasing the biasing force for disengaging the clip from engagement with the resistance object.

9. The device of claim 1 further comprising:

a pair of opposed clips defining the clip;

a handle frame, the handle frame defined by a crossmember attached between the pair of opposed clips;

a receptacle defined by a slot in each of the opposed clips for receiving a handle of the resistance object, the handle extending parallel to the crossmember; and a hand grip, the hand grip disposed between the opposed clips and adapted to simultaneously retract the restraint by movement against the biasing member for releasing the handle from the clips.

10. A restraint device for preventing unexpected or uncontrolled movement of exercise equipment, comprising:

a pair of clips, each clip adapted to engage a resistance object, the resistance object prone to inertial movement from external force;

a linkage adapted to attach the clip to a tether, the tether exerting a counterforce against the inertial movement of the resistance object to prevent injury;

a restraint for securing the clip in communication with the resistance object;

a biasing member for biasing the restraint in engagement with the resistance object during exertion of the counterforces;

a handle frame, the handle frame defined by a crossmember attached between the pair of opposed clips;

a receptacle defined by a respective slot in each clip of the opposed clips for receiving a handle of the resistance object, the handle extending parallel to the crossmember; and a hand grip, the hand grip disposed between the opposed clips and adapted to simultaneously retract the restraint by movement against the biasing member for releasing the handle from the clips, wherein the biasing member further comprises a spring biasing the restraint against the handle in an interference fit, the hand grip responsive to retract the restraint by compressing the springs.

11. The device of claim 1 further comprising:

an overhead frame having a retention bar, the tether engaging the retention bar and exhibiting a resistance force against the tether at least as great as the inertial movement of the resistance object.

12. The device of claim 11 further comprising a plurality of tethers and respective clips, wherein each tether of the plurality of tethers is attached to the respective clip, and wherein the plurality of tethers forms a loop, the loop engaged around the retention bar.

13. A safety restraint device for a free weight, comprising:

opposed clips adapted for attachment to a handle of a free weight having opposed plates attached to the handle, the clips having a spacing for engaging the handle at locations flanking a grip region of the handle;

a receptacle defined by a respective slot on each of the clips for receiving the handle;

a tether attached to at least one of the opposed clips; and a restraint for securing the handle in the slot of each clip, the restraint having a spring loaded actuator for biasing the restraint in a secured position.

14. The device of claim 13 wherein the restraint is responsive to disengage from securing the handle in the receptacle when unbiased by a release force.

15. The device of claim 13 wherein the tether attaches to both clips forming a loop configured for suspension around an overhead member.

16. The device of claim 15 wherein the overhead member is a retention bar adapted for supporting the free weight.

17. A safety restraint device for a free weight, comprising:

opposed clips adapted for attachment to a handle of a free weight, the clips having a spacing for engaging the handle at locations flanking a grip region of the handle;

a receptacle on the clips for receiving the handle;

a tether attached to at least one of the opposed clips; and a restraint for securing the clip to the handle, the restraint having a spring loaded actuator for biasing the restraint in a secured position, wherein the restraint includes a pair of elongated outriggers, each outrigger responsive to the actuator for biasing against a respective plate attached to opposed ends of the handle.

18. The device of claim 17 wherein each outrigger is slideably engaged with a respective clip, the each outrigger securing the receptacle in engagement with the handle when biased against the plates, and releasing the handle from the receptacle when the spring loaded actuator is unbiased for disposing the outriggers away from the plates.

19. The device of claim 18 wherein the outriggers are responsive to a hand grip for disposing the outriggers away from the plates responsive to disposing the hand grip against the spring bias.

20. The device of claim 13 wherein the opposed clips define the grip region based on a location for engaging each receptacle with the handle.

21. A system for restraining a free weight against unexpected or uncontrolled movement, comprising:

a clamp for attachment to a resistance object, the clamp including:

a clip adapted to engage a resistance object, the resistance object prone to inertial movement from external forces and having a handle between opposed plates of a free weight;

a linkage adapted to attach the clip to a tether, the tether exerting a counterforce against the inertial movement of the resistance object to prevent injury;

a restraint for securing the clip in communication with the resistance object by receiving the handle in a slot of the clip; and a biasing member for biasing the restraint in engagement with the resistance object disposed in the slot during exertion of the counterforces; and a frame for receiving the tether, the tether configured for suspending the resistance object at a predetermined height.

22. The device of claim 1 wherein the tether is a fixed length for defining a predetermined distance of movement of the resistance object.

* * * * *